US008448343B2

(12) United States Patent
Nakako

(10) Patent No.: US 8,448,343 B2
(45) Date of Patent: May 28, 2013

(54) EYEGLASS LENS PROCESSING APPARATUS AND CALIBRATION SENSOR UNIT

(75) Inventor: Yuya Nakako, Aichi (JP)

(73) Assignee: Nidek Co., Ltd., Aichi (JP)

( * ) Notice: Subject to any disclaimer, the term of this patent is extended or adjusted under 35 U.S.C. 154(b) by 449 days.

(21) Appl. No.: 12/893,464

(22) Filed: Sep. 29, 2010

(65) Prior Publication Data

US 2011/0074439 A1 Mar. 31, 2011

(30) Foreign Application Priority Data

Sep. 30, 2009 (JP) ..... 2009-229114

(51) Int. Cl.
*G01B 21/00* (2006.01)
*A61B 3/00* (2006.01)

(52) U.S. Cl.
USPC ..... 33/502; 33/200

(58) Field of Classification Search
USPC ..... 33/200, 502, 507
See application file for complete search history.

(56) References Cited

U.S. PATENT DOCUMENTS 5,161,333 A 11/1992 Lecerf et al.
5,806,198 A 9/1998 Guillermin
6,071,176 A * 6/2000 Kruis ..... 33/28
6,327,790 B1 12/2001 Sillon
7,172,490 B2 * 2/2007 Campisi et al. ..... 451/5
7,668,617 B2 * 2/2010 Vassard et al. ..... 700/186
2001/0018312 A1 8/2001 Gottschalk
2003/0087584 A1 5/2003 Shibata
2008/0289200 A1 * 11/2008 Jouard ..... 33/200
2010/0088056 A1 * 4/2010 Igarashi et al. ..... 702/95
2010/0292946 A1 * 11/2010 Tamai et al. ..... 702/94

FOREIGN PATENT DOCUMENTS

JP 8-318458 A 12/1996
JP 2000-127015 A 5/2000
JP 2003-145328 A 5/2003

OTHER PUBLICATIONS

Communication dated Dec. 22, 2010, issued in corresponding European Patent Application No. 10011731.6 (5 pages).

* cited by examiner

*Primary Examiner* — G. Bradley Bennett
(74) *Attorney, Agent, or Firm* — Sughrue Mion, PLLC

(57) ABSTRACT

An eyeglass lens processing apparatus includes lens chuck shafts, processing tools for processing a lens and processing tool rotating shafts to which the processing tools are attached. A calibration sensor unit for calibrating the eyeglass lens processing apparatus includes: an attachment portion attached to the lens chuck shafts; a contact member contacting the processing tools; a support mechanism configured to movably support the contact member and has an urging member that urges the contact member in a direction separating from the attachment portion; and a sensor that detects the contact of the contact member with the processing tools. The urging member has an urging force by which the processing tool rotating shafts and the lens chuck shafts are not bent to a predetermined tolerance or more when the contact member contacts the processing tools and is moved toward the attachment portion.

4 Claims, 12 Drawing Sheets

EYEGLASS LENS PROCESSING APPARATUS AND CALIBRATION SENSOR UNIT

BACKGROUND

The present invention relates to a calibration sensor unit for calibrating an eyeglass lens processing apparatus that processes or finishes a peripheral edge of an eyeglass lens.

An eyeglass lens processing apparatus includes lens chuck shafts for holding an eyeglass lens, a lens chuck shaft rotating mechanism, a rotating mechanism for rotating a processing tool rotating shaft to which a grindstone as a processing tool for processing or finishing the peripheral edge of the eyeglass lens, an X moving mechanism for moving the processing tool and the lens relatively to the axial direction of the lens chuck shafts (an X-axis direction) and a Y moving mechanism for moving the lens chuck shafts in a direction (a Y-axis direction) for changing an axial distance between the lens chuck shafts and the processing tool rotating shaft. In this device, in order to precisely process or finish the peripheral edge of the eyeglass lens by the processing tool such as the grindstone, a positional relation between each processing tool and the lens chuck shafts (positions of the lens chuck shafts in the Y-axis direction and the X-axis direction relative to the processing tool) needs to be calibrated.

As a calibrating technique, a technique is proposed in which a calibrating template having a circular outline in a part is held by a pair of lens chuck shafts in place of an eyeglass lens, a carriage for holding the lens chuck shafts so as to freely rotate is lowered to move the template toward a grindstone, and when the template contacts the grindstone, the movement of the carriage is stopped, so that the stop of the movement of the carriage is detected by a sensor provided in a Y moving mechanism (JP-A-8-318458 (U.S. Pat. No. 5,806,198)). Further, a technique is proposed in which the surface of a processing tool such as a grindstone has an electric conductivity, a holding part of a template is electrically insulated, the surface of the template is formed with an electrically conductive member and a current supplied between the surface of the processing tool and the surface of the template is detected to electrically detect the contact of the processing tool with the template (JP-A-2000-127015 (U.S. Pat. No. 6,327,790)).

Since the rigidity of the lens chuck shafts and the processing tool rotating shaft is not high, when a load is applied thereto, the lens chuck shafts and the processing tool rotating shaft are bent. Especially, in the technique disclosed in JP-A-8-318458 (U.S. Pat. No. 5,806,198), since the contact of the template with the grindstone by the movement of the carriage is detected in accordance with the stop of the lowering movement of the carriage, a stop position includes an error due to the bending of the lens chuck shafts and the processing tool rotating shaft. Particularly, since the processing tool rotating shaft to which a chamfering grindstone with a small diameter or a grooving tool is attached is small and light, the rigidity is low. Further, since the contact of the template with the grindstone is detected under a state that the processing tool rotating shaft is bent, accuracy is more reduced. On the other hand, the technique disclosed in JP-A-2000-127015 (U.S. Pat. No. 6,327,790) is proposed as an improvement of the technique disclosed in JP-A-8-318458 (U.S. Pat. No. 5,806,198), however, the processing tool such as the grindstone needs to have the electric conductivity and the technique cannot be employed in a processing tool having no electric conductivity. Further, the processing tool is rotated at high speed by a rotating mechanism having a bearing for holding the processing tool rotating shaft so as to freely rotate. When the rotating mechanism such as the bearing does not have the electric conductivity, the technique disclosed in JP-A-2000-127015 (U.S. Pat. No. 6,327,790) cannot be used. Further, since a ball arranged in the bearing contacts the rotating shaft, a current may not be necessarily stably supplied. When the flow of the current in the processing tool rotating mechanism is unstable, the contact of the calibrating template with the grindstone cannot be precisely detected.

SUMMARY

By considering the above-described problems of the usual techniques, it is a technical object of the present invention to provide a calibration sensor unit for calibrating an eyeglass lens processing apparatus that can accurately calibrate a positional relation between a processing tool and a lens chuck shafts notwithstanding whether or not the processing tool and a processing tool rotating mechanism have an electric conductivity.

In order to solve the above-described problems, the aspects of the disclosure provide the following arrangements.

(1) A calibration sensor unit for calibrating an eyeglass lens processing apparatus including a lens chuck shaft extending in a first direction for holding an eyeglass lens, a processing tool for processing a peripheral edge of the lens and a processing tool rotating shaft to which the processing tool is attached, the calibration sensor unit comprising:

an attachment portion configured to be attached to the lens chuck shaft;

a contact member configured to contact the processing tool;

a support mechanism configured to support the contact member so as to be movable in a second direction orthogonal to the first direction when the attachment portion is attached to the lens chuck shaft;

a sensor configured to detect the contact of the contact member with the processing tool; and a signal transmitting portion configured to transmit a detecting signal of the sensor to the eyeglass lens processing apparatus, wherein the support mechanism includes an urging member configured to urge the contact member in a direction separating from the attachment portion, the urging member has an urging force by which the processing tool rotating shaft and the lens chuck shaft are not bent to a predetermined tolerance or more when the contact member contacts the processing tool and is moved toward the attachment portion, and wherein the sensor is provided at one of the contact member and the attachment portion and arranged in such a position that the sensor can detect that the contact member is moved toward the attachment portion against the urging force of the urging member.

(2) The calibration sensor unit according to (1), wherein the urging member has the urging force by which when the contact member is directed upward, the contact member is not moved toward the attachment portion due to an own weight of the contact member so that the sensor does not react to the movement of the contact member.

(3) The calibration sensor unit according to (1), wherein the sensor is arranged in such a position that the sensor detects that the contact member is moved by a minute distance or a predetermined distance toward the attachment portion.

(4) The calibration sensor unit according to (1), wherein the support mechanism includes: a shaft attached to the contact member and extending to the second direction, a bearing arranged in the attachment portion to guide the shaft so as to be movable in the second direction, and a stopper configured to regulates the movement of the contact member in the direction separating from the attachment portion to a predetermined amount, the contact member includes a first surface configured to contact the processing tools and a second surface opposite to the first surface, the sensor includes a sensor main body, a measuring shaft supported on the sensor main body so as to be movable in the second direction, the measuring shaft having an end configured to contact the second surface of the contact member, and a switch circuit configured to detect that the end of the measuring shaft is pressed by the second surface, the urging member urges the measuring shaft toward the second surface of the contact member under a state that the end of the measuring shaft contacts the second surface, and a distance between a position where the end of the measuring shaft is pressed and a position where the contact of the contact member with the processing tool detected by the switch circuit is adjusted to a minute distance smaller than a tolerance of a size in a lens processing work or a predetermined distance.

DETAILED DESCRIPTION OF EXEMPLARY EMBODIMENTS

Figure 1:
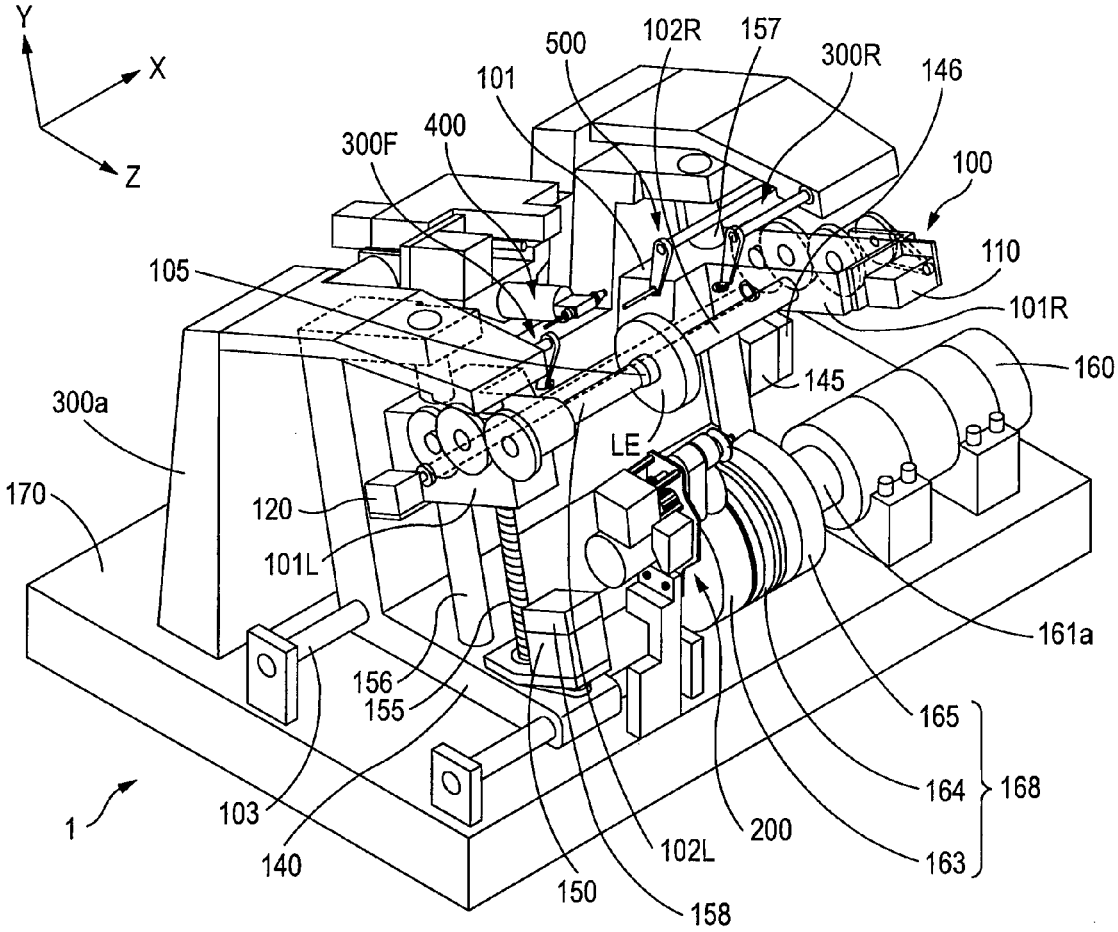
FIG. 1 is a schematic structural diagram of a glass processing apparatus as an exemplary embodiment of the present invention.

An exemplary embodiment of the present invention will be described by referring to the drawings. FIG. 1 is a structural example of an eyeglass lens processing apparatus according to the embodiment of the disclosure.

A carriage 101 that holds a pair of lens chuck shafts 102L and 102R L so as to freely rotate is mounted on a base 170 of a processing apparatus 1. A peripheral edge of an eyeglass lens LE which is held between the chuck shafts 102L and 102R is pressed to and processed by grindstones respectively included in a group of grindstones 168 attached coaxially to a spindle (a rotating shaft of a processing tool) 161*a*. The group of grindstones 168 includes a rough grindstone 162 for plastic, a finishing grindstone 163 having a V groove for forming a bevel and a flat-finishing surface, a finishing grindstone 164 having a front bevel finishing surface for forming a front bevel and a rear bevel finishing surface for forming a rear bevel of a high curve lens and a polishing grindstone 165 having a groove for forming a bevel and a flat-finishing surface. The grindstone spindle 161*a* is rotated by a motor 160. A grindstone rotating unit is formed by the above-described members. As a rough processing tool and a finishing tool, a cutter may be used.

The lens chuck shaft 102R is moved toward the lens chuck shaft 102L by a motor 110 attached to a right arm 101R of the carriage 101. Further, the lens chuck shafts 102R and 102L are synchronously rotated by a motor 120 attached to a left arm 101L through a rotation transmitting mechanism such as a gear. An encoder 120*a* for detecting rotation angles of the lens chuck shafts 102R and 102L is attached to a rotating shaft of the motor 120. The above-described members form a chuck shaft rotating unit.

The carriage 101 is mounted on a support base 140 movable along shafts 103 and 104 extending in an X-axis direction and linearly moved in the X-axis direction (an axial direction of the chuck shaft) in accordance with the rotation of a motor 145. An encoder 146 for detecting a moving position of the chuck shaft in the X-axis direction is attached to a rotating shaft of the motor 145. These members form an X-axis direction moving unit. Further, shafts 156 and 157 which extend in a Y-axis direction (a direction in which an axial distance between the chuck shafts 102L and 102R and the grindstone spindle 161*a* is varied) are fixed to the support base 140. The carriage 101 is mounted on the support base 140 so as to be movable in the Y-axis direction along the shafts 156 and 157. A Y-axis moving motor 150 is fixed to the support base 140. The rotation of the motor 150 is transmitted to a ball screw 155 extending in the Y-axis direction. The carriage 101 is moved in the Y-axis direction by the rotation of the ball screw 155. An encoder 158 for detecting a moving position of the chuck shaft in the Y-axis direction is attached to a rotating shaft of the motor 150. The above-described members form a Y-axis direction moving unit (an axial distance varying unit).

In FIG. 1, in an upper part of the carriage 101, lens edge position detecting units 300F and 300R are provided. As the structures of the detecting units 300F and 300R, a structure disclosed in JP-A-2003-145328 (U.S. Pat. No. 6,790,124) may be basically used.

Figure 2:
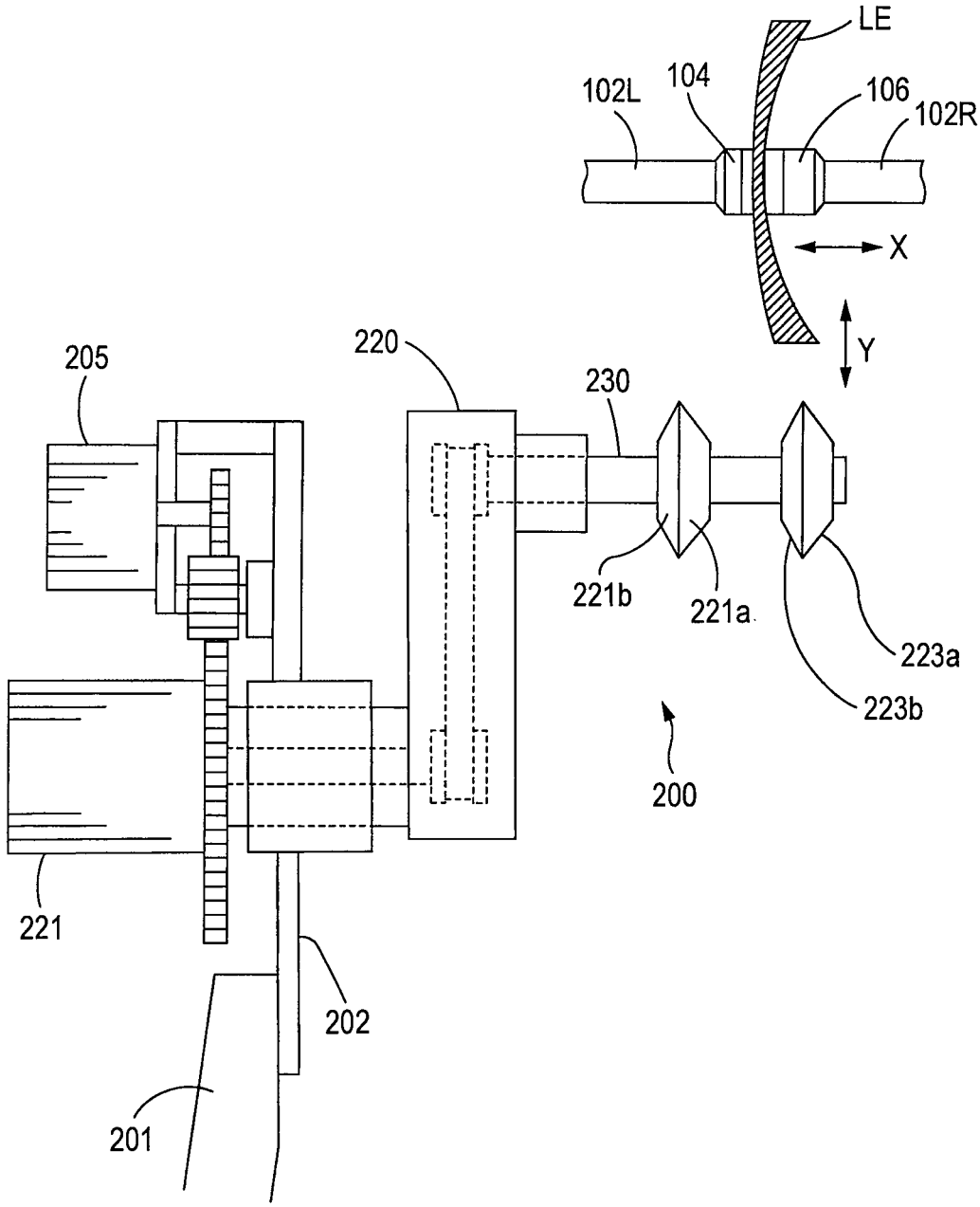
FIG. 2 is a structural diagram of a chamfering unit.

In FIG. 1, a chamfering unit 200 is arranged in a front side of a device main body. FIG. 2 is a structural diagram of the chamfering unit 200. A chamfering grindstone 221*a* for the front surface of a lens, a chamfering grindstone 221*b* for the rear surface of the lens, a chamfer-polishing grindstone 223*a* for the front surface of the lens and a chamfer-polishing grindstone 223*b* for the rear surface of the lens as chamfering tools are coaxially attached to a grindstone rotating shaft (a rotating shaft of a processing tool) 230 attached to an arm 220 so as to freely rotate. The rotating shaft 230 is rotated by a motor 221 through a rotation transmitting mechanism such as a belt in the arm 220. The motor 221 is fixed to a fixing plate 202 extending from a support base block 201. Further, a motor 205 for rotating the arm is fixed to the fixing plate 202. When the motor 205 is rotated, the rotating shaft 230 is moved to a processing position shown in FIG. 2 from a retracted position. The processing position of the rotating shaft 230 is located at a position on a plane (a plane of the X-axis and the Y-axis) where both the rotating shafts of the lens chuck shafts 102R and 102L and the grindstone spindle 161*a* are located between the lens chuck shafts 102R and 102L and the grindstone spindle 161*a*. The lens LE is moved in the Y-axis direction by the motor 150 and the lens LE is moved in the X-axis direction by the motor 145 to chamfer the peripheral edge of the lens similarly to a processing work of the peripheral edge of the lens by the grindstones 168.

Figure 3:
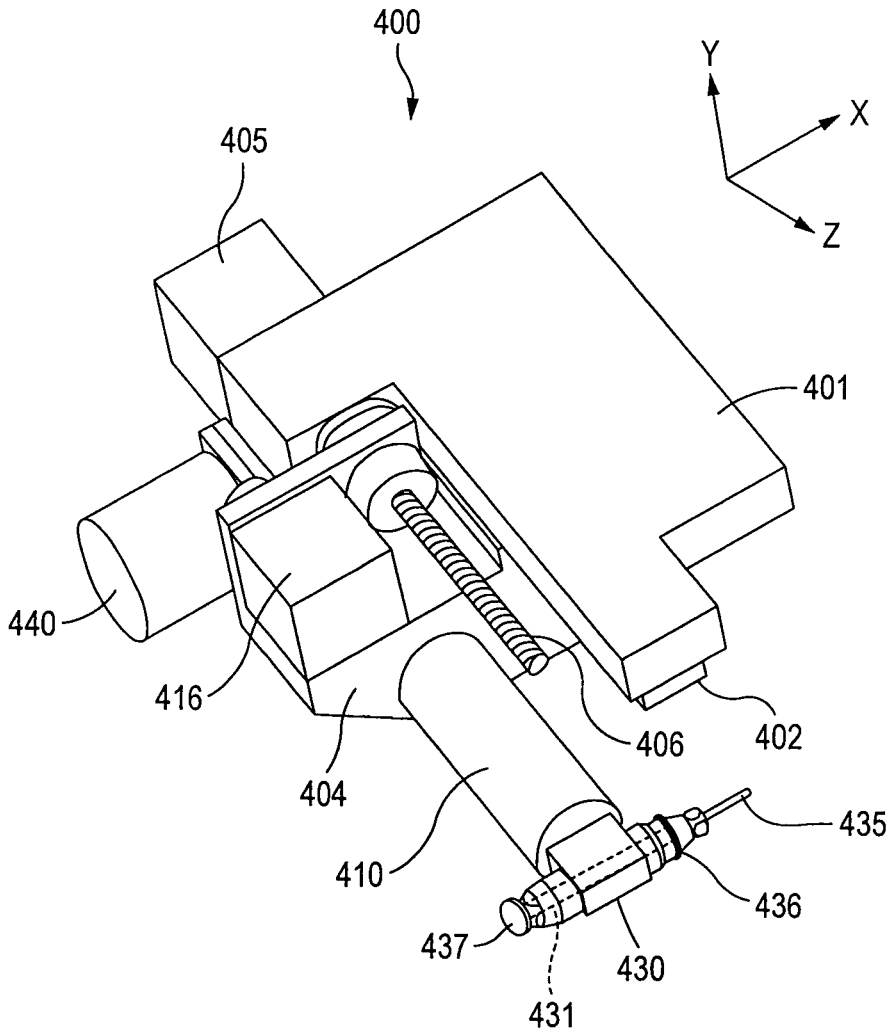
FIG. 3 is a structural diagram of a drilling and grooving unit.

A drilling and grooving unit 400 is arranged in a rear part of the carriage part 100. FIG. 3 is a schematic structural diagram of the unit 400. A fixing plate 401 as a base of the unit 400 is fixed to a block 300*a* provided upright on the base 170 shown in FIG. 1. A rail 402 extending in a Z-axis direction (a direction orthogonal to the X and Y directions) is fixed to the fixing plate 401, and a moving support base 404 is attached along the rail 402 so as to freely slide. The moving support base 404 is moved in the Z-axis direction by rotating a ball screw 406 by a motor 405. A rotating support base 410 is held by the moving support base 404 so as to freely rotate. The rotating support base 410 is rotated on an axis by a motor 416 through a rotation transmitting mechanism.

A rotating part 430 is attached to an end part of the rotating support base 410. A rotating shaft 431 orthogonal to the axial direction of the rotating support base 410 is held by the rotating part 430 so as to freely rotate. An end mill 435 as a drilling tool and a cutter 436 as a grooving tool are coaxially attached to one end of the rotating shaft 431. A step bevel grindstone 437 as a processing tool for modifying or processing a bevel surface or bevel foot is coaxially attached to the other end of the rotating shaft 431. The rotating shaft 431 is rotated by a motor 440 attached to the moving support base 404 through a rotation transmitting mechanism arranged in the rotating part 430 and the rotating support base 410.

Figure 4:
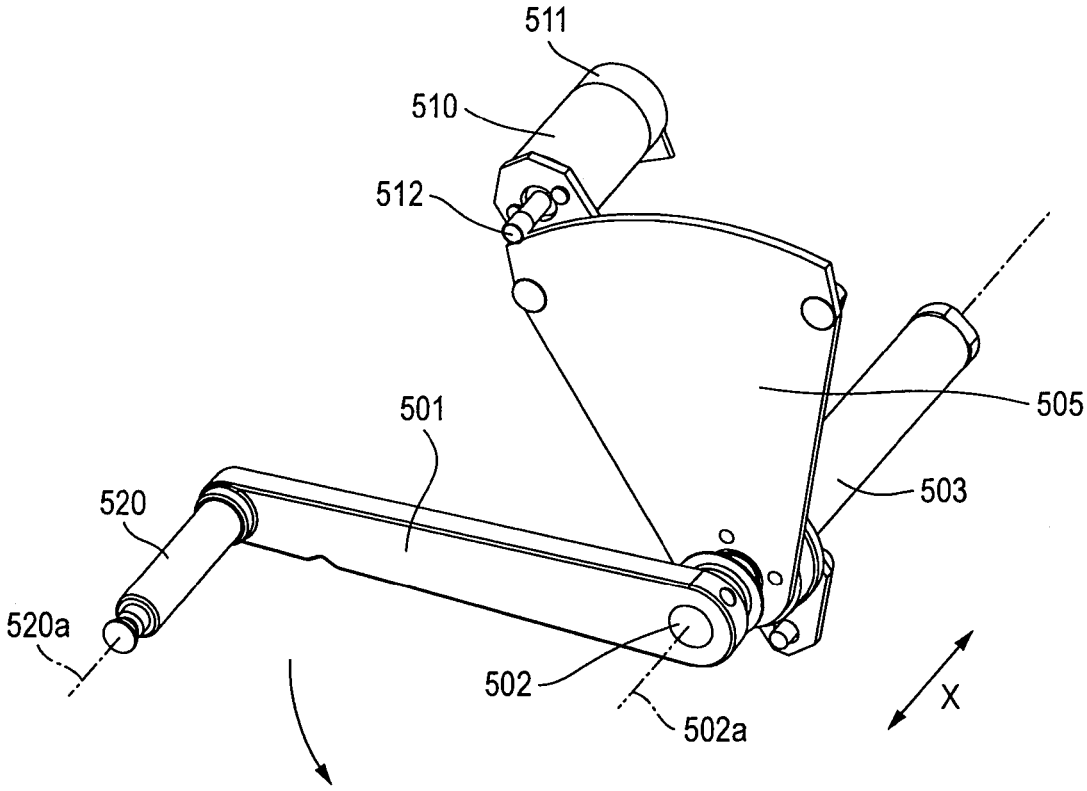
FIG. 4 is a schematic structural diagram of a lens outside diameter detecting unit.

In FIG. 1, in a rear part of an upper part of the lens chuck shaft 102R side, a lens outside diameter detecting unit 500 is arranged. FIG. 4 is a schematic structural diagram of the lens outside diameter detecting unit 500. A cylindrical tracing stylus 520 which is allowed to contact the edge of the eyeglass lens LE is fixed to one end of an arm 501 and a rotating shaft 502 is fixed to the other end of the arm 501. A central axis 520*a* of the tracing stylus 520 and a central axis 502*a* of the rotating shaft 502 are arranged with a positional relation parallel to the lens chuck shafts 102L and 102R (the X-axis direction). The rotating shaft 502 is held by a holding part 503 so as to freely rotate on the central axis 502*a*. The holding part 503 is fixed to the block 300*a* shown in FIG. 1. Further, a sector shaped gear 505 is fixed to the rotating shaft 502 and the gear 505 is rotated by a motor 510. A pinion gear 512 engaged with the gear 505 is attached to a rotating shaft of the motor 510. Further, an encoder 511 is attached to the rotating shaft of the motor 510.

Figure 5:
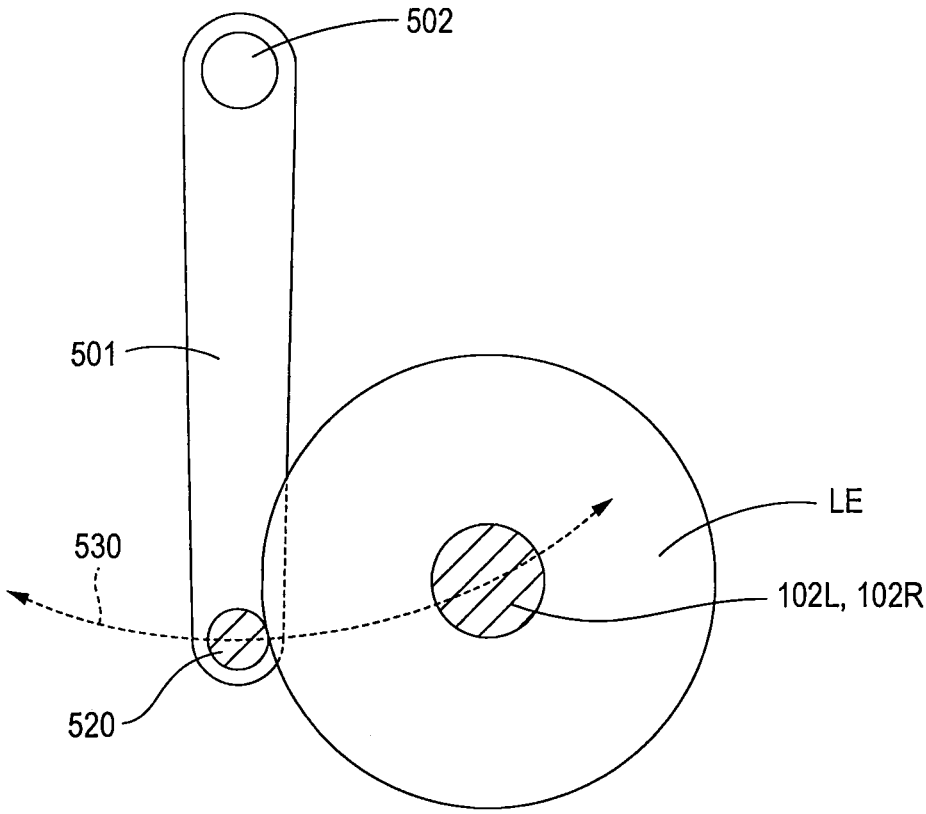
FIG. 5 is a diagram for explaining a detection of the outside diameter of a lens.

When the outside diameter of the lens LE is measured, as shown in FIG. 5, the lens chuck shafts 102L and 102R are moved to predetermined measuring positions (on a moving path 530 of the central axis 520*a* of the tracing stylus 520 rotated on the rotating shaft 502). When the arm 501 is rotated by the motor 510, the tracing stylus 520 located at a retracted position is moved to the lens LE side and the cylindrical part 521 of the tracing stylus 520 is allowed to contact the edge of the lend LE. Further, a predetermined measuring pressure is applied to the tracing stylus 520 by the motor 510. Then, when the chuck shafts 102L and 102R are rotated once, the lens LE is also rotated once. The lens LE is rotated for each of steps of predetermined minute angles. The movement of the tracing stylus 520 at this time is detected by the encoder 511 to measure the outside diameter of the lens LE on the chuck shafts (a radius of the lens LE on the chuck shafts).

Figure 6:
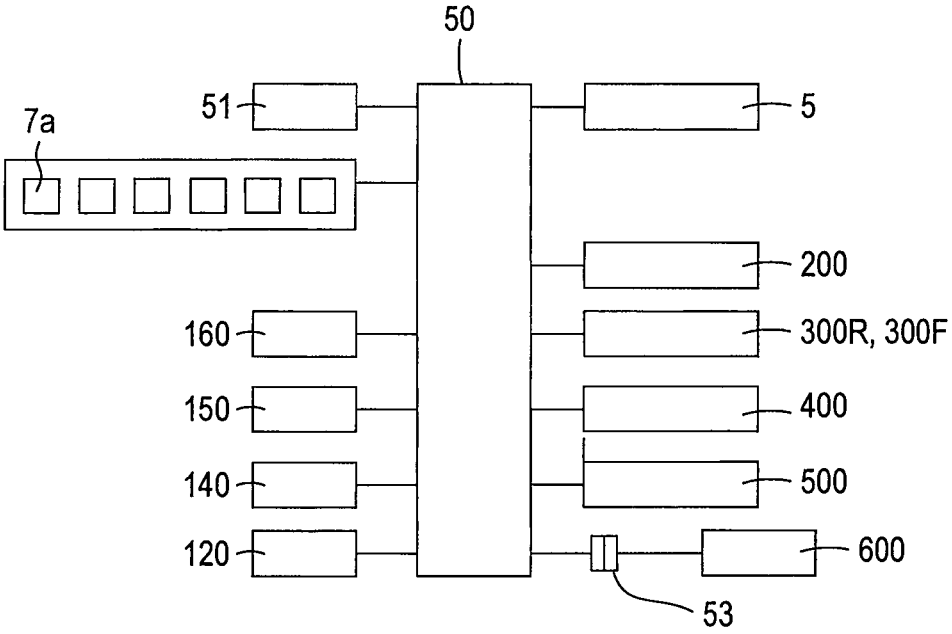
FIG. 6 is a block diagram of a control system of the lens processing apparatus.

FIG. 6 is a control block diagram of the eyeglass lens processing apparatus. The motors 120, 145 and 150 for rotating and moving the lens chuck shafts, the motor 160 for rotating the group of grindstones 168, the lens edge position detecting units 300F and 300R, the chamfering unit 200, the drilling and grooving unit 400 and the lens outside diameter detecting unit 500 are connected to a control unit 50. Further, a display 5 having a touch panel function for inputting data of processing conditions, a switch part 7 provided with a processing start switch, a memory 51 and a glass frame form measuring device (an illustration is omitted) are connected to the control unit 50. Further, a switch 7*a* for starting calibrating programs of calibration modes using a below-described calibration sensor unit 600 is provided in the switch part 7. The calibrating programs of the calibration modes are stored in the memory 51. A communication cable 650 as a communication unit of the calibration sensor unit 600 is connected to a communication port 53

Figure 7:
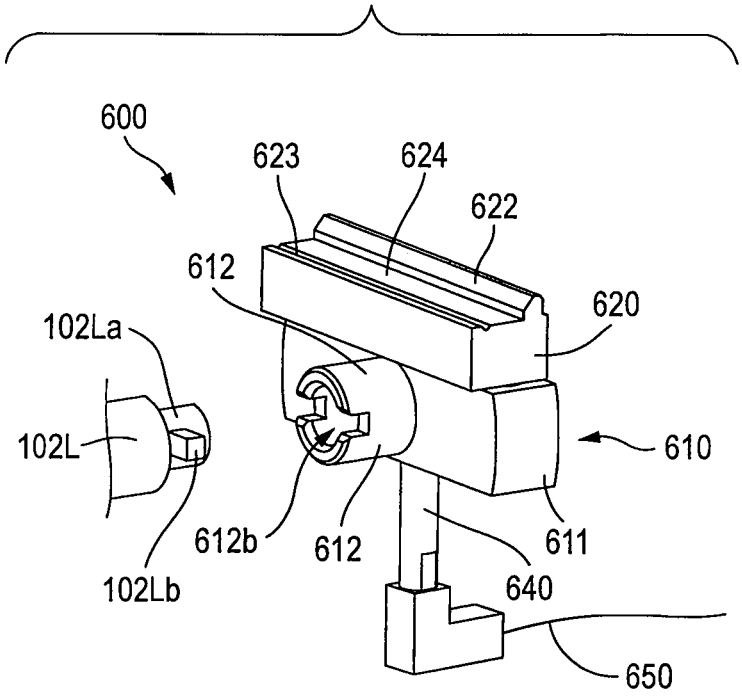
FIG. 7 is a perspective view of an external appearance of a calibration sensor unit.
Figure 8:
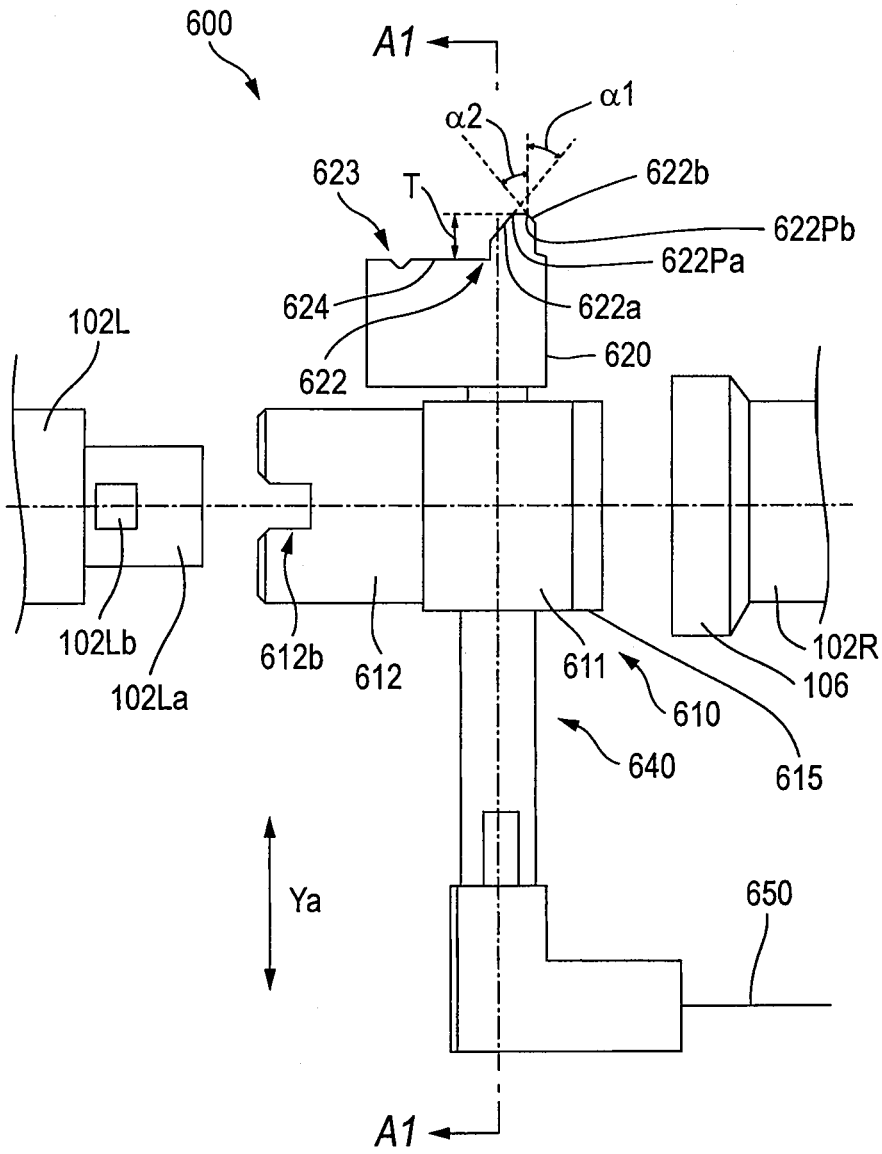
FIG. 8 is a side view of the calibration sensor unit.
Figure 9:
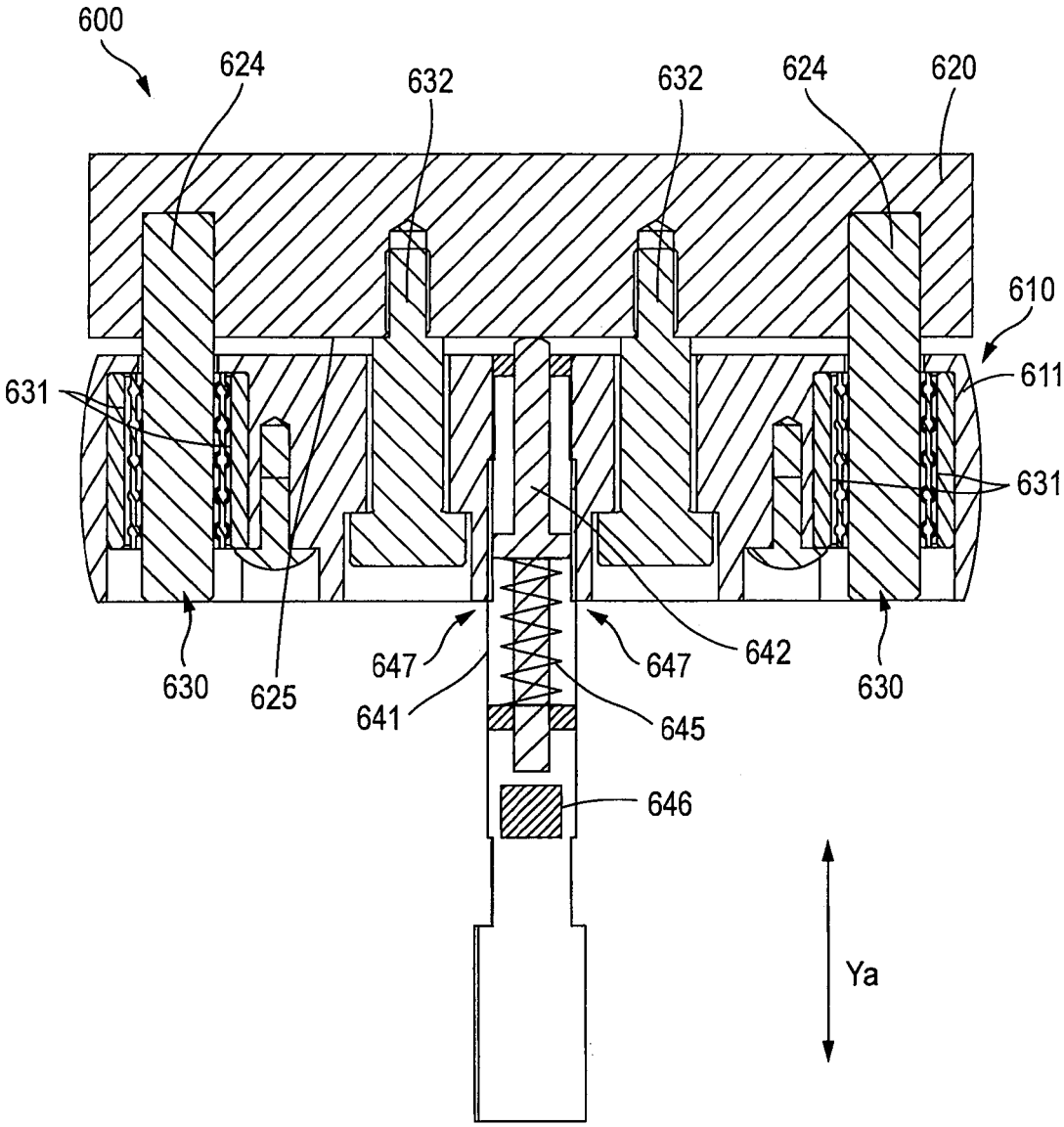
FIG. 9 is a sectional view taken along a line A1-A1 of FIG. 8.

FIGS. 7, 8 and 9 are schematic structural diagrams of the calibration sensor unit 600 for calibrating the eyeglass lens processing apparatus. FIG. 7 is a perspective view of an external appearance of the calibration sensor unit 600. FIG. 8 is a side view of the calibration sensor unit 600. FIG. 9 is a sectional view taken along a line A1-A1 of FIG. 8.

The calibration sensor unit 600 includes an attachment portion 610 attached to the lens chuck shafts, a contact member (a movable part) 620 that is allowed to contact the processing tool, a support mechanism (a support part) 630 that supports the contact member 620 so as to be movable in a predetermined direction relative to the attachment portion 610, a sensor (a touch sensor) 640 for detecting the movement of the contact member 620 and a cable 650 for transmitting a detecting signal of the sensor 640 to the control unit 50 of the processing apparatus 1.

The attachment portion 610 includes a base 611 and an attaching part 612 as a positioning part for attaching the base 611 with a predetermined positional relation to the lens chuck shaft 102L. Two pins 102L*b* are fixed to an end part 102L*a* of the lens chuck shaft 102L. A cup holder 105 for holding a cup fixed to the lens LE is attached to the end part 102L*a* and the pins 102L*b*. A hole 612*a* into which the end part 102L*a* is inserted and two recessed parts 612*b* to which the pins 102L*b* are fitted are formed in the attaching part 612. The pins 102L*b* are fitted to the recessed parts 612*b*, so that the position of the base 611 is set to a predetermined relation to a rotating angle of the lens chuck shaft 102L. Further, a flat part 615 on which a lens pressing member 106 attached to an end of the lens chuck shaft 102R abuts is formed in an opposite side to the attaching part 612 with respect to the base 611. When the attaching part 612 is attached to the lens chuck shaft 102L and the lens chuck shaft 102R is moved toward the lens chuck shaft 102L as in chucking the lens LE, the base 611 is chucked by the two lens chuck shafts 102L and 102R.

The contact member 620 is supported by a support mechanism 630 (described later) so as to be movable in a direction (refer it to as a direction Ya) orthogonal to the X-axis direction in which the base 611 is held by the lens chuck shaft 102L. When the contact member 620 is directed upward, as shown in FIG. 8, the side surface form of the contact member 620 substantially has a T-shape. In FIG. 8, in a right upper end of the contact member 620, a protruding part 622 is formed that is allowed to contact the finishing grindstone 163, and chamfering grindstones 221*a* and 221*b*. The protruding part 622 has a mountain-shaped part of a size inserted into the V groove for forming the bevel provided in the finishing grindstone 163. The tilt angles $\alpha 1$ and $\alpha 2$ of tilt surfaces 622*a* and 622*b* of the mountain-shaped part are set to be smaller than the front bevel finishing tilt surface and the rear bevel finishing tilt surface of the V groove for forming the bevel. Further, a height T of the protruding part 622 to a flat surface 624 is set to be larger than a depth of the V groove for forming the bevel of the finishing grindstone 163. Thus, when the protruding part 622 is inserted into the V groove for forming the bevel, an apex 622P*a* of the tilt surface 622*a* or an apex 622P*b* of the tilt surface 622*b* may contact the front bevel finishing tilt surface or the rear bevel finishing tilt surface of the V groove for forming the bevel. Further, in FIG. 8, on the flat surface 624 of the contact member 620, a V groove 623 of a size is formed into which the cutter 436 as the grooving tool can be inserted. The apexes 622P*a* and 622P*b* of the protruding part 622, a center of the V groove 623 and the flat surface 624 are formed to be respectively linear and distances of the apexes 622P*a*, 622P*b* of the protruding part 622, the center of the V groove 623 and the flat surface 624 relative to the center of chuck (the X-axis) of the base 611 are respectively set by known values in design.

As the sensor 640, in an example shown in FIG. 9, a contact plunger type touch sensor is used and arranged in the base 611. For instance, the contact plunger type touch sensor provided by Metrol Co., Ltd. may be preferably employed. The sensor 640 includes a mechanism that holds a measuring shaft 642 allowed to contact a detector in a main body 641 so as to freely slide, a spring 645 (an urging member) for constantly urging the measuring shaft 642 to the detector side and a switch circuit 646 for detecting that the measuring shaft 642 is pressed by the detector against an urging force of the spring 645. An end of the measuring shaft 642 provided in the sensor 640 is arranged at a position opposed to a surface 625 of the contact member 620 relative to the base 611 (a surface opposite to the surface of the contact member 620 in contact with the processing tool). A detecting direction of the sensor 640 corresponds to the direction Ya in which the contact member 620 is moved. The sensor 640 is provided with a screw part 647 as an adjusting mechanism for moving forward and backward the measuring shaft 642 in the axial direction to adjust the movement of a minute distance of the contact member 620. The screw part 647 has a screw ridge for screwing the main body part 641 to the base 611. The minute distance is adjusted by rotating the sensor 640 to move the sensor toward the contact member 620. When the contact of the measuring shaft 642 with the contact member 620 is detected by the switch circuit 646, the sensor 640 is rotated in a reverse direction to adjust the minute distance of the contact member 620. An amount of the rotation of the sensor 640 in a reverse direction is determined so as to set the movement of the contact member 620 to the minute distance. For instance, when the sensor 640 moves forward by 0.5 mm by rotating the sensor 640 once, if the sensor 640 is reversely rotated for 3.6°, the sensor 640 is moved backward by 5 μm. In such a way, the minute distance of the movement of the contact member 620 is adjusted. After the minute distance of the contact member 620 is adjusted by the screw part 647, a forward and backward movement is fixed to the screw part 647 by a set screw not shown in the drawing.

The support mechanism 630 for supporting the contact member 620 so as be movable in the direction Ya includes two guide shafts 634 attached to the contact member 620 and extending in the direction Ya, bearings 631 attached to the base 611 to guide the guide shafts 634 so as to be respectively movable in the direction Ya and two fixing screws 632 for preventing the contact member 620 from slipping out from the base 611. Further, the spring 645 arranged in the sensor 640 is used as an urging member for urging the contact member 620 to separate from the base 611 along the direction Ya. The fixing screws 632 serve as stoppers for regulating the movement of the contact member 620 in a direction of separating from the attachment portion 610 to a predetermined amount.

The sensor 640 detects that the contact member 620 is moved by the minute distance Δya toward the base 611. The minute distance Δya is set to be smaller than an allowable accuracy (50 μm) of the outside diameter of the lens LE. For instance, the sensor having a detecting accuracy of 5 μm is used. Then, a screw amount of the adjusting mechanism of the sensor 640 is adjusted so that the sensor 640 may detect the movement of the minute distance of 5 μm. A distance detected by the switch circuit 646 after the end of the measuring shaft 642 is pressed is preferably adjusted to the minute distance smaller than a tolerance of a size in lens processing work, and may be adjusted to a previously set previous distance.

The urging force of the spring 645 is set to a level in which when the contact member 620 is allowed to contact the processing tool, the lens chuck shafts 102L and 102R and the rotating shafts of the processing tools (the grindstone spindle 161*a*, the rotating shaft 230 of the chamfering grindstone, the rotating shaft 431 of the cutter 436) are not bent. Further, the urging force of the spring 645 is set to a level in which even when the contact member 620 is directed upward, the sensor 640 does not react due to the own weight of the contact member 620 (the contact member 620 is not moved to the base side). For instance, when an allowable load by which the rotating shaft of the processing tool is not bent is 1.0N(=100 g weight) and the weight of a movable member including the contact member 620 is 40 g, if the spring 645 is used whose urging force (a detected load by the sensor 640) is 0.5 N(=50 g weight), the contact of the processing tool with the contact member 620 can be accurately detected.

As the sensor 640 for detecting the movement of the contact member 620 when the contact member 620 is allowed to contact the processing tool, various kinds of sensors may be used, such as an optical encoder for detecting the movement of the contact member 620, an encoder using a gear or an electrostatic capacity sensor. When the sensor 640 is compact and light, the sensor 640 may be arranged in the contact member 620 side.

As the urging member (the spring 645) forming the support mechanism 630 for constantly urging the contact member 620 to be separated from the base 11, the urging member provided in the sensor 640 is used as described above. However, an exclusive urging member may be provided in the contact member 620 or the base 11 or between the contact member 620 and the base 611. The urging member may be formed not only with a spring, but also various kinds of elastic members such as a rubber, visco-elastic material can be used.

Now, an example of a calibrating operation of the eyeglass lens processing apparatus using the calibration sensor unit 600 will be described below. An operator fixes the sensor unit 600 to the chuck lens axis 102L to move the chuck shaft 102R toward the sensor unit 600 as in chucking the lens LE, so that the sensor unit 600 is chucked by the two chuck shafts 102L and 102R. The operator connects the cable 650 of the sensor unit to the communication port 53. When the calibration start switch 7*a* is pressed, the calibrating program is executed by the control unit 50.

Figure 10:
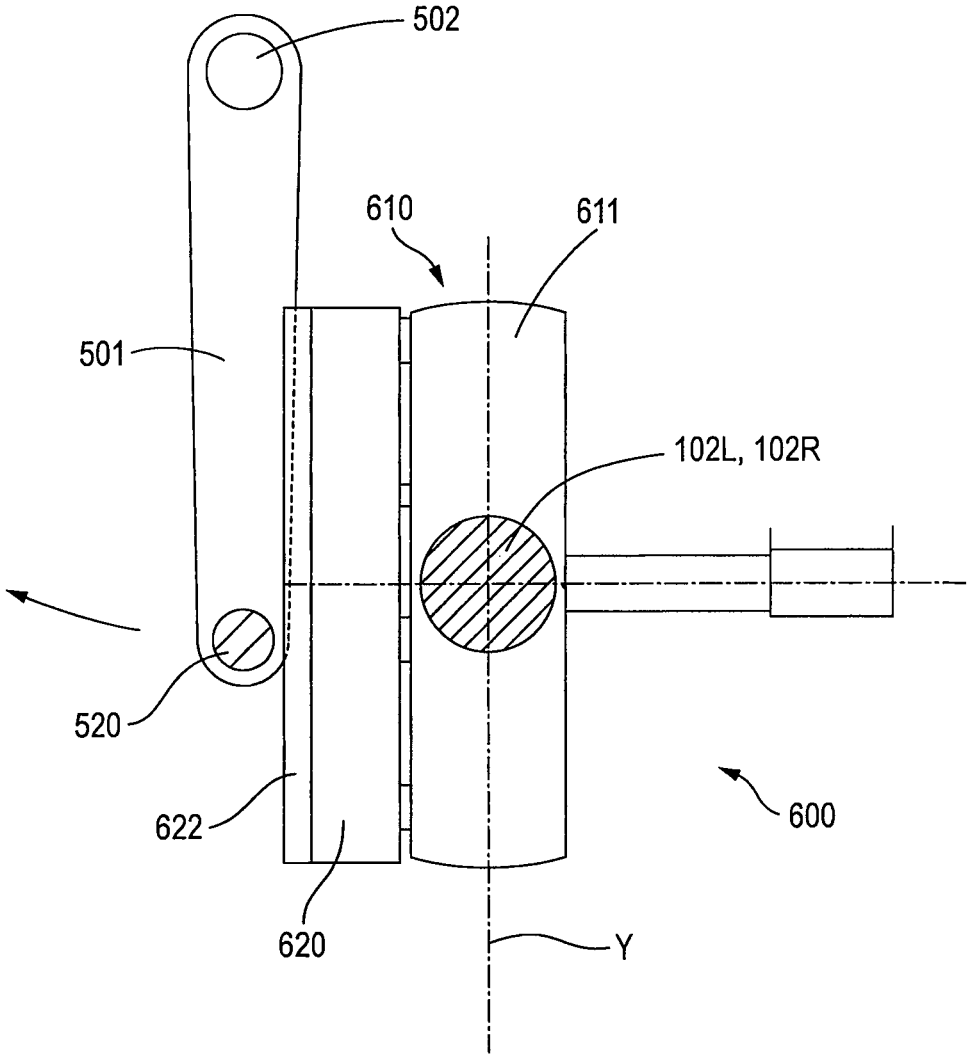
FIG. 10 is a diagram for explaining a correction of an angle of a reference surface of a contact member of the sensor unit and an acquisition of a distance of the reference surface to the center of a chuck.

Initially, an angle of a reference surface of the contact member 620 of the sensor unit 600 is corrected and a distance of the reference surface to the center of the chuck is obtained by using the lens outside diameter detecting unit 500. The control unit 50 rotates, as shown in FIG. 10, the chuck shafts 102L and 102R in accordance with rotation control data before a calibration so that the reference surface of the contact member 620 (the protruding part 622) is parallel to the Y-axis direction. Then, the control unit 50 drives the lens outside diameter detecting unit 500 to allow the tracing stylus 520 to contact the contact member 620. Under this state, the control unit moves the chuck shafts 102L and 102R by a predetermined distance ΔY (for instance, 20 mm) in the Y axis direction. A varied amount of the tracing stylus 520 at this time is detected by the encoder 511 to obtain a relation between the rotating angle of the sensor unit 600 an the reference surface of the contact member 620 in accordance with the detected data of the encoder 511. When the varied amount of the tracing stylus 520 is zero, the reference surface of the contact member 620 is parallel to the Y axis direction. Thus, the rotation control data does not need to be corrected. On the other and, when the chuck shafts 102L and 102R are moved by the predetermined distance ΔY in the Y-axis direction, if the varied amount of the tracing stylus 520 is Δd, correction angle data (Δθ) is obtained by $\tan(\Delta\theta)=\Delta d/\Delta Y$.

Then, after the control unit 50 corrects the reference surface of the contact member 620 of the sensor unit 600 to be parallel to the Y-axis direction in accordance with the obtained correction angle data (Δθ), the control unit operates again the lens outside diameter detecting unit 500 to allow the tracing stylus 520 to contact the contact member 620. In accordance with the detected data of the encoder 511, a distance D of the reference surface of the contact member 620 to the center of the chuck shafts 102L and 102R is obtained.

Since the lens outside diameter detecting unit 500 is used as described above to obtain the control angle and the distance D of the reference surface of the contact member 620, even when the relation between the angle of the reference surface of the contact member 620 and the distance to the center of the chuck is not highly accurately fabricated, the calibrating operation of the processing apparatus 1 using the sensor unit 600 can be highly accurately achieved.

Subsequently, the control unit is shifted to a calculating process of an eccentric amount of a center of rotation of the processing tool relative to the Y-axis in the processing apparatus 1. When the outside diameter of the lens LE is processed or finished, a processed or finished form is managed on the assumption that the Y-axis direction in which the chuck shafts 102L and 102R are moved and the center of rotation of the processing tool such as the grindstone 163 have a predetermined relation in view of a design. In the design of the present device, the center of rotation of the processing tool is supposed to be located on the Y-axis. However, when the center of the rotation of the processing tool deviates from the Y-axis to such an amount exceeding a tolerance, this deviation needs to be calibrated.

Figure 11B:
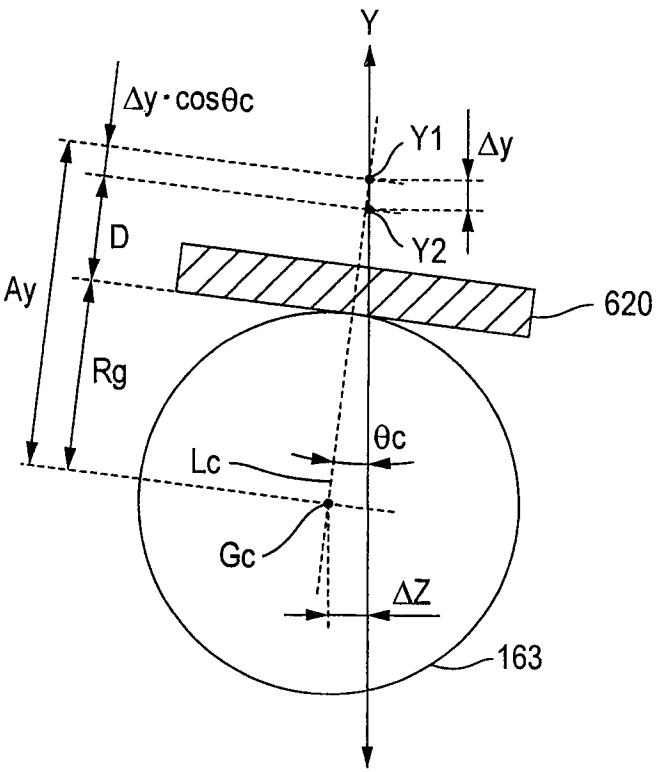
FIG. 11B is a diagram for explaining a calculation of an eccentric amount of the center of rotation of a processing tool relative to the Y axis.
Figure 11A:
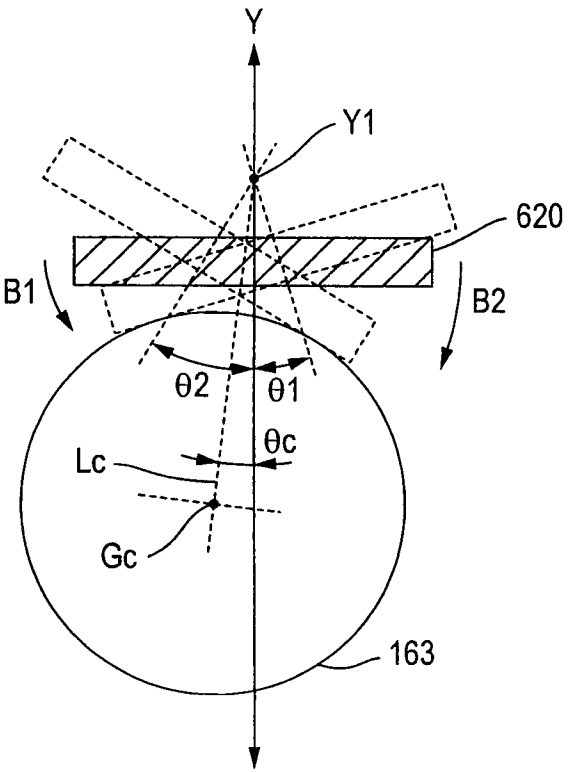
FIG. 11A is a diagram for explaining a calculation of an eccentric amount of the center of rotation of a processing tool relative to a Y axis.

FIG. 11A and FIG. 11B are diagrams for explaining a calculation of the eccentric amount of the center of rotation of the processing tool relative to the Y-axis. In FIGS. 11A and 11B, the finishing grindstone 163 is used as an example. The control unit 50 rotates the chuck shafts 102R and 102L so that the reference surface of the contact member 620 is located at right angles to the Y-axis and moves the chuck shafts 102R and 102L in the X-axis direction so that the contact member 620 (the protruding part 622) is located on the flat-finishing surface (on an already known radius Rg of the grindstone) of the finishing grindstone 163. After that, the control unit moves the chuck shafts 102R and 102L (the sensor unit 600) toward the grindstone 163 to stop the movement in the Y-axis direction at a position Y1 (a position set in view of a design) where the contact member 620 does not contact the grindstone 163. Under this state, as shown in FIG. 11A, initially, the control unit slowly rotates the chuck shafts 102R and 102L (the sensor unit 600) in a direction shown by an arrow mark B1. When the contact member 620 (a first contact part) is allowed to contact the grindstone 163 in accordance with this rotation, the contact member 620 is moved by a minute distance Δya toward the base 611 and this movement is detected by the sensor 640.

When a contact detecting signal is inputted from the sensor 640, the control unit 50 immediately stops the rotation of the chuck shafts 102R and 102L to obtain a deflection angle θ1 relative to the Y-axis with respect to the position Y1 as a reference from the rotating angle of the chuck shaft at this time. Then, the control unit 50 slowly rotates the chuck shafts 102R and 102L (the sensor unit (600) in a direction shown by an arrow mark B2 opposite to the direction shown by the arrow mark B1 to obtain a deflection angle θ2 relative to the Y-axis with respect to the position Y1 as a reference from the rotating angle of the chuck shaft at this time, when the sensor 640 detects that the contact member 620 (the first contact part) contacts the grindstone 163.

In FIG. 11A, assuming that the center of rotation of the grindstone is Gc, a straight line passing the position Y1 and the center of rotation of the grindstone Gc is Lc and a deflection angle of the straight line Lc relative to the Y-axis with respect to the position Y1 as a reference is θc, the following relation is obtained.

$$\theta c=(\theta 1-\theta 2)/2 \quad \text{(Equation 1)}$$

Then, as shown in FIG. 11B, the control unit 50 rotates the sensor unit 600 on the basis of the deflection angle θc so that the contact member 620 is located at a position orthogonal to the straight line Lc. The control unit 50 moves the chuck shafts 102R and 102L toward the grindstone along the Y-axis direction and stops the movement in the Y-axis direction when the sensor 640 detects that the contact member 620 (a third contact part) comes into the grindstone 163 and obtain a position Y2 on the center of the chuck on the Y-axis at this time by a detecting signal from the encoder 158. Here, assuming that a distance in the Y-axis direction between the position Y1 and the position Y2 is Δy, the radius of the grindstone 163 is Rg and the distance of the reference surface of the contact member 620 relative to the center of the chuck is D and a distance in the direction of the straight line Lc from the center of the grindstone Gc to the position Y1 is Ay, the distance Ay is obtained by a below-described equation.

$$Ay=\Delta y\cdot\cos\theta c+D+Rg \quad \text{(Equation 2)}$$

Further, assuming that an eccentric amount of the center of grindstone Gc relative to the Y-axis is ΔZ,
ΔZ is obtained by a below-described equation.

$$\Delta Z=Ay\cdot\sin\theta c \quad \text{(Equation 3)}$$

The eccentric amount ΔZ is stored in the memory 51. When the outside diameter of the lens LE is processed or finished by the grindstone 163, a contact point of the lens LE and the grindstone 163 is calculated on the basis of control data of the chuck shaft in the Y-axis direction and the eccentric amount ΔZ.

When the contact of the contact member 620 with the grindstone 163 is detected as described above, if the contact member 620 contacts the grindstone 163, the contact member 620 is moved by the minute distance Δya toward the base 611 and this movement is detected by the sensor 640. The urging force of the spring 645 for pressing the contact member 620 toward the grindstone is set to a level in which the chuck shafts 102R and 102L and the spindle 161*a* are not bent. Accordingly, the contact of the grindstone 163 with the contact member 620 is accurately detected. Further, since the sensor unit 600 of this device is not designed to detect the contact by detecting a current supplied state to the processing tool, even when the grindstone 163 and a bearing in the spindle 161*a* do not have an electric conductivity, the contact of the contact member with the processing tool can be accurately detected.

Figure 12:
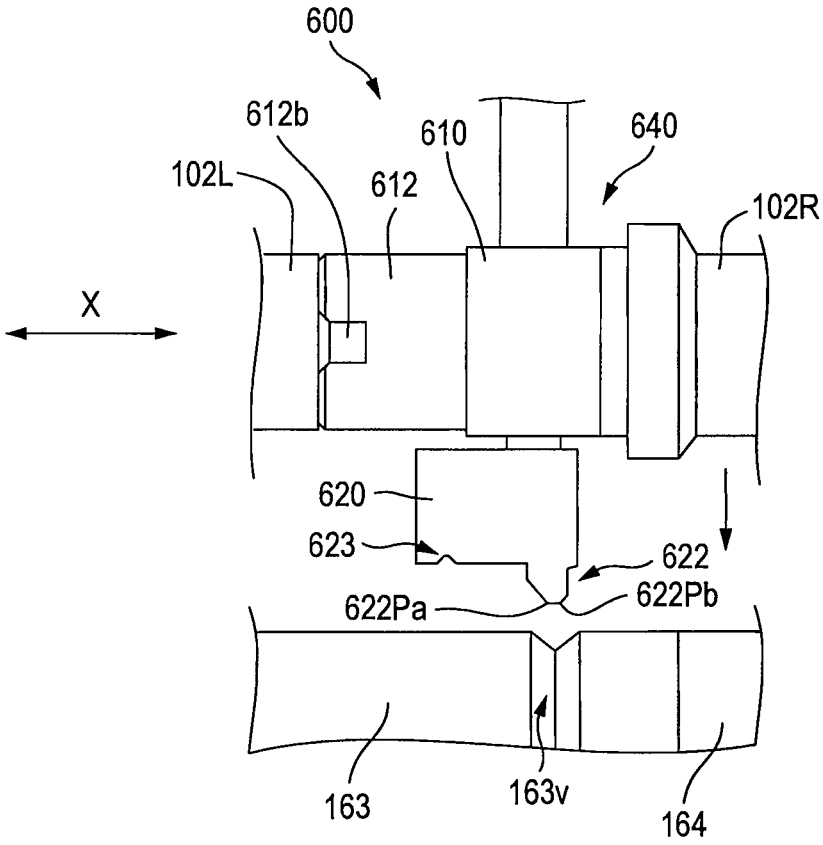
FIG. 12 is a diagram for explaining a calibration of positions of a V groove for forming a bevel in an X-axis direction and a Y-axis direction.

Now, the calibration of positions of the V groove for forming the bevel in the finishing grindstone 163 in the X-axis direction and the Y-axis direction will be described below. As shown in FIG. 12, the control unit 50 moves the chuck shafts 102R and 102L in the X-axis direction to locate the protruding part 622 of the contact member 620 on the V groove 163*v* of the grindstone 163. Further, the control unit 50 locates the reference surface of the contact member 620 to be vertical to the Y-axis. Then, the control unit 50 moves the chuck shafts in the X-axis direction at intervals of predetermined distances of 0.1 mm in accordance with X-axis position data of the V groove 163*v* before a calibration so that the apex 622P*a* of the protruding part 622 contacts a plurality of measuring positions of the front bevel finishing surface of the V groove 163*v*, and lowers the chuck shafts 102R and 102L in the Y-axis direction respectively at the measuring positions. In the measuring positions respectively, it is detected by the sensor 640 that the apex 622P*a* contacts the front bevel finishing surface of the V groove 163*v* and the Y-axis position of the center of the chuck at this time is detected by the encoder 158.

Similarly, the control unit 50 moves the chuck shafts in the X-axis direction at intervals of predetermined distances so that the apex 622P*b* of the protruding part 622 contacts a plurality of measuring positions of the rear bevel finishing surface of the V groove 163*v*, and lowers the chuck shafts 102R and 102L in the Y-axis direction respectively at the measuring positions. In the measuring positions respectively, the sensor 640 detects that the apex 622P*b* contacts the rear bevel finishing surface of the V groove 163*v* and the Y-axis position of the center of the chuck at this time is detected by the encoder 158.

The control unit 50 calculates a tilt of the front bevel finishing surface in accordance with the control data of the Y-axis position and the X-axis position obtained by the contact of the apex 622P*a* with the front bevel finishing surface of the V groove 163*v*. Similarly, the control unit 50 calculates a tilt of the rear bevel finishing surface in accordance with the control data of the Y-axis position and the X-axis position obtained by the contact of the apex 622P*b* with the rear bevel finishing surface of the V groove 163*v*. Then, an intersection of both the tilts in the X-axis direction is obtained at a central position of the V groove 163*v* and it is stored in the memory 51 as calibration data of the V groove in the X-axis direction.

When the position of the V groove 163*v* in the X-axis direction is obtained, the control unit 50 moves the sensor unit 600 in the X-axis direction so that the center of the protruding part 622 of the contact member 620 is located at the center of the V groove 163*v*, and then moves the chuck shafts to the V groove 163*v*. When the sensor 640 detects that the contact member 620 contacts the V groove 163*v*, calibration data of the position in the Y-axis direction is obtained.

Subsequently, the control unit is shifted to a calibrating process of the chamfering unit 200. In the chamfering grindstone 221*a* attached to the chamfering unit 200, the calibration data of an eccentric amount of a center of rotation of the chamfering grindstone 221*a* is obtained in accordance with the same method as that shown in FIGS. 11A and 11B. The X-axis positions and Y-axis positions of tilt surfaces of the chamfering grindstones 221*a* and 221*b* are obtained in the same manner as that in the V groove of the finishing grindstone 163. Since the rotating shaft 230 of the chamfering unit 200 is small relative to the grindstone spindle 161*a* of the finishing grindstone 163 with a large diameter, the rigidity of the rotating shaft 230 is lower than the rigidity of the grindstone spindle 161*a* and the rotating shaft 230 is easily bent. Since the above-described sensor unit 600 can detect the contact with the processing tool under such a contact pressure as not to bend the rotating shaft 230 of the small processing tool, the sensor unit 600 can accurately detect a positional relation between the chuck shafts and each processing tool.

A calibration of the drilling and grooving unit 400 will be briefly described below. When the cutter 436 of the grooving tool is calibrated, the contact member 620 is directed upward by the rotation of the chuck shafts 102L and 102R. The rotating shaft 431 of the drilling and grooving unit 400 is controlled to be parallel to the X-axis. The flat surface 624 of the contact member 620 is located at a position where the flat surface 624 is allowed to contact the cutter 436. In accordance with the same method as shown in FIGS. 11A and 11B, the calibration data of an eccentric amount of a center of a processing work of the cutter 436 relative to the Y-axis is obtained. In accordance with the corrected or calibration data, a processing reference position (a processing reference position on the Z-axis) of the drilling and grooving unit 400 is corrected. Further, the sensor unit 600 is sequentially moved in the X-axis direction to detect a position where the cutter 436 is inserted into the V groove 623 of the contact member 620. Thus, the calibration data of the cutter 436 in the X-axis position and the Y-axis position is obtained.

As described above, even when the contact member 620 is directed upward, since the spring 645 of the support mechanism 630 of the sensor unit 600 has the urging force set to a level to which the sensor 640 does not react due to the own weight of the contact member 620, an erroneous detection can be prevented. Further, the rotating shaft 431 of the unit 400 has a rigidity lower than the rigidity of the grindstone spindle 161*a*, and is easily bent, however, since the contact with the processing tool can be detected under the a contact pressure in which the rotating shaft 431 is not bent, the positional relation between the chuck shafts and each processing tool can be accurately detected.

As described above, the relation between the processing tool and the lens chuck shafts can be accurately calibrated, notwithstanding whether or not the processing tool and the processing tool rotating mechanism have an electric conductivity. Further, since an urging force of a member in contact with the processing tool is smaller than the rigidity of the processing tool, a calibration can be realized without bending the processing tool.

In the above-described exemplary embodiment, the contact member 620 is formed in a linear shape and a contact part is held in a positional relation orthogonal to the moving direction of the touch sensor 640. However, when a positional relation between the chuck shafts and the contact member (the contact part) in the sensor unit is determined, the positional relation is not limited to the above-described orthogonal relation.

Further, when the positional relation between the touch sensor 640 and the contact part is determined, the contact member 620 may be formed in a curved shape. In this case, the contact member 620 preferably has a circular arc shape having the same radius with the center of the chuck as a center. In the circular arc shape having the same radius, even when the surface of the processing tool contacts any position of the circular arc shape, a distance in the Y-axis direction to the center of the chuck does not change.

What is claimed is:

1. A calibration sensor unit for calibrating an eyeglass lens processing apparatus including a lens chuck shaft extending in a first direction for holding an eyeglass lens, a processing tool for processing a peripheral edge of the lens and a processing tool rotating shaft to which the processing tool is attached, the calibration sensor unit comprising:

an attachment portion configured to be attached to the lens chuck shaft;

a contact member configured to contact the processing tool;

a support mechanism configured to support the contact member so as to be movable in a second direction orthogonal to the first direction when the attachment portion is attached to the lens chuck shaft;

a sensor configured to detect the contact of the contact member with the processing tool; and a signal transmitting portion configured to transmit a detecting signal of the sensor to the eyeglass lens processing apparatus, wherein the support mechanism includes an urging member configured to urge the contact member in a direction separating from the attachment portion, the urging member has an urging force by which the processing tool rotating shaft and the lens chuck shaft are not bent to a predetermined tolerance or more when the contact member contacts the processing tool and is moved toward the attachment portion, and wherein the sensor is provided at one of the contact member and the attachment portion and arranged in such a position that the sensor can detect that the contact member is moved toward the attachment portion against the urging force of the urging member.

2. The calibration sensor unit according to claim 1, wherein the urging member has the urging force by which when the contact member is directed upward, the contact member is not moved toward the attachment portion due to an own weight of the contact member so that the sensor does not react to the movement of the contact member.

3. The calibration sensor unit according to claim 1, wherein the sensor is arranged in such a position that the sensor detects that the contact member is moved by a minute distance or a predetermined distance toward the attachment portion.

4. The calibration sensor unit according to claim 1, wherein the support mechanism includes: a shaft attached to the contact member and extending to the second direction, a bearing arranged in the attachment portion to guide the shaft so as to be movable in the second direction, and a stopper configured to regulates the movement of the contact member in the direction separating from the attachment portion to a predetermined amount, the contact member includes a first surface configured to contact the processing tools and a second surface opposite to the first surface, the sensor includes a sensor main body, a measuring shaft supported on the sensor main body so as to be movable in the second direction, the measuring shaft having an end configured to contact the second surface of the contact member, and a switch circuit configured to detect that the end of the measuring shaft is pressed by the second surface, the urging member urges the measuring shaft toward the second surface of the contact member under a state that the end of the measuring shaft contacts the second surface, and a distance between a position where the end of the measuring shaft is pressed and a position where the contact of the contact member with the processing tool detected by the switch circuit is adjusted to a minute distance smaller than a tolerance of a size in a lens processing work or a predetermined distance.

* * * * *